US007268102B2

(12) United States Patent
Beilfuss et al.

(10) Patent No.: US 7,268,102 B2
(45) Date of Patent: Sep. 11, 2007

(54) GLYCERYL ETHERS AS PRESERVATIVES FOR COOLING LUBRICANTS

(75) Inventors: Wolfgang Beilfuss, Hamburg (DE); Ralf Gradtke, Tornesch (DE); Wolfgang Siegert, Ellerau (DE); Karl-Heinz Diehl, Norderstedt (DE); Klaus Weber, Hamburg (DE)

(73) Assignee: Air Liquide Sante (International), Paris Cedex (FR)

( * ) Notice: Subject to any disclaimer, the term of this patent is extended or adjusted under 35 U.S.C. 154(b) by 574 days.

(21) Appl. No.: 10/448,975

(22) Filed: May 30, 2003

(65) Prior Publication Data

US 2003/0232729 A1 Dec. 18, 2003

(30) Foreign Application Priority Data

Jun. 5, 2002 (DE) ..... 102 24 978

(51) Int. Cl.
*C10M 129/16* (2006.01)

(52) U.S. Cl. ..... 508/579; 508/580

(58) Field of Classification Search ..... 508/579, 508/580

See application file for complete search history.

(56) References Cited

U.S. PATENT DOCUMENTS

| | | | | |
|---|---|---|---|---|
| 5,516,510 | A | 5/1996 | Beilfuss et al. | |
| 5,539,001 | A | 7/1996 | Waldmann-Laue et al. | |
| 5,591,442 | A | 1/1997 | Diehl et al. | |
| 5,639,719 | A * | 6/1997 | Tanaka et al. | 508/580 |
| 5,670,160 | A | 9/1997 | Eggensperger et al. | |
| 5,736,574 | A | 4/1998 | Burnier et al. | |
| 5,858,931 | A * | 1/1999 | Tanaka et al. | 508/364 |
| 6,040,347 | A | 3/2000 | Cupferman et al. | |
| 6,204,225 | B1 | 3/2001 | Lightcap, Jr. | |
| 6,403,541 | B1 * | 6/2002 | Kambara et al. | 508/579 |
| 6,420,323 | B2 * | 7/2002 | Geke et al. | 508/532 |
| 6,465,399 | B2 * | 10/2002 | Koishikawa et al. | 508/416 |
| 6,956,062 | B2 * | 10/2005 | Beilfuss et al. | 514/723 |

FOREIGN PATENT DOCUMENTS

| | | |
|---|---|---|
| DE | 40 26 756 | 2/1992 |
| DE | 41 40 473 C2 | 6/1993 |
| DE | 42 40 674 | 3/1994 |
| DE | 100 25 124 | 11/2001 |
| EP | 0 846 461 A | 6/1998 |
| EP | 1 122 297 A | 8/2001 |
| WO | WO 01/93825 A1 | 12/2001 |

* cited by examiner

*Primary Examiner*—Ellen M. McAvoy
(74) *Attorney, Agent, or Firm*—Young & Thompson

(57) ABSTRACT

Cooling lubricant (concentrate or solution) comprising a cooling lubricant base based on mineral and/or synthetic oil and preservative comprising (a) one or more 1- or 2-($C_3$ to $C_{24}$ alkyl) glyceryl ethers.

2 Claims, No Drawings

GLYCERYL ETHERS AS PRESERVATIVES FOR COOLING LUBRICANTS

This application claims the benefit of priority under 35 U.S.C. § 119 (a) and (b) to German Application No. 102 24 978.4, filed Jun. 5, 2002, the entire contents of which are incorporated herein by reference

BACKGROUND

The present invention relates to a preservative for cooling lubricants.

Presently in the market there is an intensive search for new possibilities of preserving cooling lubricants without formaldehyde. Formaldehyde-free formations have been preserved to date by the use of boric acid (up to 12% by weight), in combination where appropriate with a fungicide. This alternative, however, will be lost in future owing to the classification of boric acid (above a level of 5% by weight) as a category 2 reproductive toxin. At present there are few alternatives to boric acid on the market (e.g. phenoxyethanol, phenoxy-propanols, lactic acid derivatives), but these lag far behind the conventional formaldehyde depot substances in their activity. Consequently there is a need for effective formaldehyde-free and boric-acid-free preservatives for cooling lubricants.

Moreover, the use of known biocides may lead to skin allergies or sensitization on contact with human skin. Biocides having a strongly electrophilic nature (e.g. isothiazolones, organohalogen compounds) in particular, as preservatives or disinfectants, feature prominently in the public debate, and their use is regulated restrictively by the legislator.

DE-C-42 40 674 discloses a deodorizing action of glyceryl monoalkyl ethers of the formula R—O—$CH_2$—CHOH—$CH_2$OH. Further described is a combination of 0.15% by weight phenoxyethanol with 0.135% by weight 1-(2-ethylhexyl) glyceryl ether (Sensiva SC 50), which additionally contains 40% by weight ethanol and 0.015% by weight dibromodicyanobutane.

DE-A-40 26 756 relates to preservatives comprising as synergistic additive substances a mixture of (a) an organic acid, (b) a monophenyl glycol ether and (c) a guanidine derivative. Examples 13 and 14 are concentrates containing more than 60% by weight phenoxyethanol and 15 or 10% by weight, respectively, glyceryl monoalkyl ether. The preservatives of DE-40 26 756 are effective against a variety of bacteria and yeasts.

DE-C-41 40 473 discloses compositions which can be used as skin antiseptics and hand disinfectants and comprise a combination of an aliphatic $C_1$ to $C_6$ alkyl alcohol component and at least one glyceryl monoalkyl ether in aqueous solution. A preferred glyceryl ether is 1-(2-ethylhexyl) glyceryl ether.

DE-A-41 24 664 describes antimicrobial mixtures comprising a synergistic combination of aryl-substituted alkanol with diol. Exemplary diols are glyceryl monoalkyl ethers.

DE-A-100 25 124 discloses preparations which include a combination of glyceryl monoalkyl ether with aryl-substituted alcohol. One preferred aryl compound is phenoxyethanol.

The known applications of glyceryl monoalkyl ethers relate in particular to preparations which are applied to human skin and which therefore must be given a particularly mild formulation. In the case of preservatives for cooling lubricants, in contrast, it is important that the antimicrobial activity is particularly pronounced and that the preservative possesses corrosion control, surface protection and material protection properties and is also stable to oxidation and hydrolysis, stable in colour, and compatible with further ingredients of cooling lubricants. In addition, preservatives for cooling lubricants must be affective against particular microbes, e.g. the yeast *Rhodotorula mucilaginosa* and the mould fungus *Fusarium oxysporum*. Moreover, the preservatives for cooling lubricants must be reliably effective over a long period of time, even at elevated temperatures. The requirements asked of a preservative for cooling lubricants, therefore, go a considerable way beyond the requirements normally imposed on a preservative for dermatological preparations.

SUMMARY

The present invention was according based on the object of providing a preservative for cooling lubricants which, firstly, renders cooling lubricants reliably microbial. Secondly, there always exists a desire for effective microbial additives for cooling lubricants which are more compatible for humankind and the environment.

DESCRIPTION OF PREFERRED EMBODIMENTS

The inventive achievement of this object consists in the addition to cooling lubricants (i.e. cooling lubricant solutions or cooling lubricant concentrates) of (a) one or more alkyl glyceryl ethers. The invention accordingly relates in particular to the control of the yeast *Rhodotorula mucilaginosa* and the fungus *Fusarium oxysporum* with glyceryl monoalkyl ethers. Over and above this it has been found that the action of the glyceryl monoalkyl ethers is reinforced by combination with (b) one or more aromatic alcohols. It was surprising that substances which had hitherto been prized particularly for their mildness in dermatological applications suitable for preserving cooling lubricants.

Examples of glyceryl monoalkyl ethers used in accordance with the invention are glyceryl monoalkyl ethers substituted in position 1 or 2 by saturated or unsaturated branched or unbranched alkyl (i.e. symmetrical or asymmetrical) glyceryl monoalkyl ethers such as n-propyl glyceryl ether, isopropyl glyceryl ether, n-butyl glyceryl ether, hexyl glyceryl ether, octyl glyceryl ether, nonyl glyceryl ether, decyl glyceryl ether, dodecyl glyceryl ether, hexadecyl glyceryl ether (chimyl alcohol), octadecyl glyceryl ether (batyl alcohol) and octadecenyl glyceryl ether (selachyl alcohol). Preference is given to 1-monoalkyl glyceryl ethers with saturated (branched or unbranched) $C_3$ to $C_{18}$ alkyl, more preferably saturated and branched $C_6$ to $C_{12}$ alkyl. Particular preference is given to 1-(2-ethylhexyl) glyceryl ether.

Besides the glyceryl monoalkyl ethers used in accordance with the invention the preservative of the invention may comprise (b) one or more aromatic alcohols. Examples of aromatic alcohols are aryl alcohols with the formula Ar—$(CHR)_n$OH, with R=independently H or $C_1$ to $C_6$ alkyl, m being preferably 1 to 6, more preferably 1 to 3, such as benzyl alcohol, phenethyl alcohols, phenylpropanols, phenylbutanols, phenylpentanols and phenylhexanols. In addition, the term aromatic alcohols also embraces the preferred glyceryl monoaryl ethers, examples being those of the formula Ar—O—$(CHR)_a$—OH with R=independently H (for $n \geqq 2$) or $C_1$ to $C_6$ alkyl, n being preferably 2 to 10, more preferably 2 to 6 and in particular 2 or 3. While the group Ar can be a ring-substituted or unsubstituted aryl group, preference is given to unsubstituted aryl, e.g. phenyl or naphthyl. Exemplary glycol monoaryl ethers used in accordance with the invention are phenoxyethanol and phenoxy-propanols. Preferred phenoxypropanols are 1-phenoxy-propan-2-ol, 2-phenoxypropan-1-ol or mixtures thereof and also 3-phenoxypropan-1-ol.

If aromatic alcohols are present in the preservative used in accordance with the invention the weight ratio of component (a) to component (b) is preferably 1:20 to 20:1, more preferably 1:10 to 10:1, in particular 1:5 to 5:1.

Furthermore, a preservative used in accordance with the invention may comprise (c) alkyl (oligo)alkanol ethers, (d) lactic esters, (e) amines or alkanolamines and (f) alcoholic solvents.

(c) Alkyl (Oligo)Alkanol Ethers

As component (c ) the preservative used in accordance with the invention may comprise one or more alkyl (oligo) alkanol ethers having the structure $R—((OCHR')_n—O)_m—H$, in which R is straight-chain or branched $C_{6-12}$ alkyl, preferably $C_8$-$C_{10}$ alkyl, especially $C_8$-alkyl, n is 2-6, preferably 2-3, especially 2, R' is H or $C_1$-$C_4$ alkyl, preferably H, and m is 1-6, preferably 1-3, in particular 1. Preferred components (c) are 2-ethylhexyl monoglycol ether, 2-ethylhexyl diglycol ether, 2-ethylhexyl oligoglycol ethers and also mixtures of the preferred alkyl (oligo)alkanol ethers, in particular of the last-mentioned substances.

In a cooling lubricant additive of the invention can comprise, besides the glycerol monoalkyl ethers used in accordance with the invention and, where appropriate, component (b), 0-40% by weight of component (c), preferably 5-20% by weight, in particular about 10% by weight.

(d) Lactic Esters

As component (d) the preservative used in accordance with the invention may comprise one or more lactic esters such as alkyl lactates and/or alkyl lactylates having an alkyl chain length of 6-12 carbon atoms and also salts thereof, in particular the alkali metal salts. Preferred lactic esters are sodium 2-caproyl-lactylate (CAS42666-88-1), sodium 2-lauroyllactylate (CAS13557-75-0), lauryl lactate and 2-ethylhexyl lactate.

The cooling lubricant used in accordance with the invention may comprise, besides the glycerol monoalkyl ether and, if desired, components (b) and/or (c), 0-40% by weight lactic esters, preferably 5-20% by weight, in particular about 10% by weight.

(e) Amines or Alkanolamines

In the preservatives used in accordance with the invention it is possible to use one or more amines or alkanolamines as pH regulators, which shift the pH of the cooling lubricant concentrates or emulsions into the preferred, slightly alkaline pH range, e.g. to a pH of 7-10, preferably 8-9. Preferred amines are 2-amino-2-methyl-1-propanol, triethanolamine, 2-ethylhexylamine and 2-ethylhexyloxypropylamine. The preservative used in accordance with the invention may comprise, besides (a) glycerol monoalkyl ethers and, if desired, components (b), (c) and/or (d), 0-40% by weight of amine/alkanolamine, preferably 5-20% by weight, in particular 10% by weight.

(f) Alcoholic Solvents

The preservatives used in accordance with the invention may comprise one or more alcoholic solvents which serve to prepare the glycerol monoalkyl ethers (or, if desired, lactic esters) used in accordance with the invention as starting components. They do not have to be separated off but instead can remain in the product. Preferred alcoholic solvents are 2-ethylhexanol, octanol, decanol, hexanol and dodecanol. The preservative used in accordance with the invention may comprise, besides glycerol monoalkyl ethers and, if desired, components (c), (d) and/or (e), 0-20% by weight of alcoholic solvent, preferably 2-10% by weight, in particular about 5% by weight.

In accordance with one embodiment of the invention the preservative is present in a cooling lubricant concentrate; a further embodiment of the invention relates to a preservative-containing cooling lubricant solution. Cooling lubricant solutions are normally prepared from a concentrate by dilution with water, for example from 1 to 5 parts by weight of concentrate and 99 to 95 parts by weight of water. Whereas accordingly, in accordance with the invention, a preserved cooling lubricant solution can be prepared by adding the preserving components (the preservative) to an unpreserved cooling lubricant solution, the cooling lubricant solution preserved in accordance with the invention is preferably prepared by mixing cooling lubricant solution preserved in accordance with the invention with water.

A preserved concentrate of this kind includes—in addition to the preservative—the concentrate base (based on mineral oil or synthetic oil) and also one or more auxiliaries. Exemplary auxiliaries are emulsifiers (e.g. anionic or nonionic emulsifiers, such as oleyl 2-cetyl polyglycol ether), emulsion stabilizers, nitrosamine scavengers, fatty acids or their salts, dyes, fungicides, extreme-pressure additives such as chlorinated paraffins, defoamers (such as metal soaps, higher alcohols, polysiloxanes), adhesion additives (e.g. polymers), corrosion inhibitors (e.g. benzotriazole and its derivatives such as amine salts, for example; polycarboxylic acids), antioxidants such as 2,4,6-tri-tert-butylphenol, odour absorbers, deodorants and surface protectants.

A cooling lubricant concentrate is preferably formulated such that the proportion of components (a) and, if desired, (b) in the inventively preserved cooling lubricant concentrate is 1 to 30% by weight, more preferably 3 to 20% by weight, in particular 5 to 15% by weight such as 7 to 13% by weight, based on the total mass of the preserved concentrate. In a ready-to-use inventively preserved cooling lubricant solution the proportion of components (a) and, if desired, (b) is preferably 0.01 to 5% by weight, more preferably 0.05 to 2% by weight, in particular 0.1 to 1% by weight, based on the total mass of the preserved cooling lubricant solution.

Owing among other factors to the solubilizing properties of components (a) an—if present—(b), (c), (d), (e) and/or (f) the preservative used in accordance with the invention possesses a stabilizing action in the concentrate and also in the solution (emulsion). Fungi in particular can be hindered very effectively from growing in an aqueous solution. The preservative used in accordance with the invention therefore offers the following advantages:

- it has a solubilizing effect,
- it imparts corrosion control, surface protection, material protection and lubricating properties,
- it has an odour-absorbing and/or deodorizing effect,
- it enhances the wear resistance
- it has a defoaming effect,
- it has no skin-harming effect,
- it is stable to oxidation and hydrolysis and stable in colour,
- it is highly compatible with other ingredients of the lubricant concentrate, and
- the addition of the preservatives does not alter the colour of the cooling lubricant solutions.

The advantages of the present invention are also evident from the following examples.

EXAMPLES

Unless indicated otherwise, indications below concerning parts and per cent refer to parts by weight and per cent by weight.

which follows indicates the number of inoculation cycles withstood by a particular sample without growth (or, if otherwise indicated, with slight growth). In the case of the data labelled "fungus" the samples were inoculated with a mixture of the yeasts and moulds specified, while the indication "mix" refers to a hybrid suspension of the stated bacteria with yeasts and moulds. The test was terminated after a maximum of 12 inoculation cycles.

| Preservatives | | Cooling lubricant 1 | | | Cooling lubricant 2 | | |
|---|---|---|---|---|---|---|---|
| | Use concentration [%][1] | Mix | Bacteria | Fungus | Mix | Bacteria | Fungus |
| | — | 0 | 8 | 0 | 0 | 5 | 0 |
| POP | 0.2 | 0 | 1 | 0 | 0 | 0 | 1 |
| POE | 0.2 | 0 | 1 | 0 | 1* | 0 | 1* |
| SC 50 | 0.2 | >12 | >12 | >12 | | | |
| | 0.16 | >12 | >12 | >12 | 2 | >12 | 2 |
| | 0.1 | 0 | >12 | 1 | 0 | 10 | 1 |
| | 0.08 | 0 | >12 | 0 | 0 | 9 | 1 |
| 20T SC50 + 80T POP | 0.4 | >12 | >12 | >12 | >12 | >12 | 4 |
| 40T SC50 + 60T POP | 0.4 | >12 | >12 | >12 | >12 | >12 | >12 |
| 50T SC50 + 50T POP | 0.4 | >12* | >12* | >12 | >12 | 0 | >12* |
| 20T SC50 + 80T POE | 0.4 | >12 | 10* | >12 | >12 | 1* | >12* |
| 50% SC50 + 50T POE | 0.4 | >12* | >12 | >12 | >12 | 0 | >12* |

*slight growth
[1]based on the preserved cooling lubricant solution

For testing the activity of preservatives of the invention they were incorporated into 4% emulsions of two different cooling lubricant concentrates in water from the Norderstedt municipal supply. The inventively preserved cooling lubricant solutions were subsequently inoculated with bacterial suspension, fungi suspension or a hybrid suspension of bacteria and fungi (Boko test).

Procedure:

First of all 4% dilutions in water from the Norderstedt municipal supply of the unpreserved cooling lubricant concentrate emulsions were prepared (samples of in each case 100 ml). This was done by adding preservatives to give the stated use concentrations. As a growth control an unpreserved sample was used.

Two days after the preservatives had been incorporated the samples were infected for the first time with 1 ml of an inoculating solution. This inoculating solution was a swabbing-off of the microbes listed below (cultured on nutrient media and then adapted to water-diluted cooling lubricant solutions). The inoculating solutions had a titer of at least $10^7$ microbes/ml.

| | | |
|---|---|---|
| Bacteria | *Escherichia coli* | ATCC 11229 |
| | *Klebsiella pneumoniae* | ATCC 4352 |
| | *Pseudomonas aeruginosa* | ATCC 15442 |
| Yeasts | *Candida albicans* | ATC 10231 |
| | *Rhodotorum mucilaginosa (rubra)* | DSM 70403 |
| Moulds | *Fusarium oxysporum* | ATCC 62318 |

The samples were inoculated twice weekly and plated out twice a week onto agar plates, the first smear taking place immediately before the second inoculation. The microbial growth of the smears was assessed following a 3-act incubation at 25° C. As a precaution, negative smears were observed for 2 days more and then assessed again. The table Result:

The results illustrated in the table make it clear that glyceryl monoalkyl ethers are highly suitable for the preservation of cooling lubricant solutions and prevent in particular the growth of the yeast *Rhodotorula mucilaginosa*, which is relevant to cooling lubricant solutions, and the fungus *fusarium oxysporum*. Through the addition of aromatic alcohols such as phenoxy-propanol or phenoxyethanol there is a reduction in the amount of glyceryl monoalkyl ether needed for preservation, which makes possible advantages in terms of cost in particular.

| Further preservatives which can be used in accordance with the invention | | | | |
|---|---|---|---|---|
| | A | B | C | D |
| 2-ethylhexyl lactate | 10 | | 10 | 10 |
| Sensiva ® SC50 | 10 | 10 | | 10 |
| 2-amino-2-methyl-1-propanol (95% strength) | 10 | 10 | 10 | |
| Phenoxyethanol | 70 | 80 | 80 | 80 |

These further preservatives which can be used in accordance with the invention are clear, colourless and have only a weak odour.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A composition comprising a cooling lubricant base based on mineral oil and/or synthetic oil and preservative comprising (a) one or more 1- or 2-($C_3$ to $C_{24}$ alkyl) glyceryl ethers, wherein the preservative further comprises (b) one or more aromatic alcohols and wherein said one or more aromatic alcohols are glycol monoaryl ethers.

2. The composition according to claim 1, wherein said (b) is at least one or more of the group consisting of phenoxypropanol and phenoxyethanol.

* * * * *